US012611071B2

(12) United States Patent
Wei et al.

(10) Patent No.: US 12,611,071 B2
(45) Date of Patent: Apr. 28, 2026

(54) SHOWER DEVICE

(71) Applicant: Beijing Kohler Ltd., Beijing (CN)

(72) Inventors: Shaopei Wei, Beijing (CN); Sai Yang, Beijing (CN)

(73) Assignee: Beijing Kohler Ltd., Beijing (CN)

( * ) Notice: Subject to any disclaimer, the term of this patent is extended or adjusted under 35 U.S.C. 154(b) by 313 days.

(21) Appl. No.: 18/451,294

(22) Filed: Aug. 17, 2023

(65) Prior Publication Data

US 2024/0074623 A1 Mar. 7, 2024

(30) Foreign Application Priority Data

Aug. 25, 2022 (CN) ..... 202222251129.2

(51) Int. Cl.
*A47K 7/04* (2006.01)
*A47K 7/02* (2006.01)

(52) U.S. Cl.
CPC ..... *A47K 7/046* (2013.01); *A47K 7/024* (2013.01)

(58) Field of Classification Search
CPC ..... A47K 7/046; A47K 7/024; A47K 7/04
USPC ..... 4/606, 605
See application file for complete search history.

(56) References Cited

U.S. PATENT DOCUMENTS 3,992,744 A * 11/1976 Fassler ..... A47K 7/046 451/356
4,858,257 A * 8/1989 Bivens ..... A47K 4/00 4/596
5,335,378 A * 8/1994 Chiang ..... A47K 7/04 4/606
5,675,846 A * 10/1997 Kannenberg ..... A46B 13/06 4/606
6,209,152 B1 * 4/2001 Kannenberg ..... A61H 7/004 4/606
6,581,219 B1 * 6/2003 Powaska ..... A47K 7/04 4/606
6,730,051 B2 * 5/2004 Lin ..... A61H 33/6089 4/606

(Continued)

FOREIGN PATENT DOCUMENTS

CN 201454721 U 5/2010
CN 204100619 U 1/2015

(Continued)

OTHER PUBLICATIONS

International Search Report & Written Opinion for PCT/CN2023/090693 dated Jan. 24, 2024, 10 pages.

*Primary Examiner* — Lori L Baker
(74) *Attorney, Agent, or Firm* — Foley & Lardner LLP

(57) ABSTRACT

A shower device includes a spray head and a massage assembly removably coupled to the spray head. The massage assembly includes a massage brush head and a driving mechanism for driving the massage brush head to move with respect to the spray head. The driving mechanism is pluggably mounted into the mounting opening. The massage brush head is removably coupled to an output shaft of the driving mechanism. The massage brush head at least partially protrudes from the spray head. In some embodiments, the massage assembly may be used independent from the spray head, and different massage brush heads may be used based on user preferences. The integration of multiple functions on a shower device improves user conveniences, expands device performance, and enhances the shower experience.

20 Claims, 7 Drawing Sheets

(56) References Cited

U.S. PATENT DOCUMENTS

| | | | | |
|---|---|---|---|---|
| 6,817,045 | B1 * | 11/2004 | Fainberg | A61H 35/00 4/606 |
| 7,157,816 | B2 * | 1/2007 | Pilcher | H02K 33/16 310/38 |
| 8,162,236 | B2 | 4/2012 | Rodenbeck et al. | |
| 8,360,668 | B1 * | 1/2013 | Hinnant | A46B 5/0075 401/6 |
| 8,621,679 | B1 * | 1/2014 | Donikian | A47K 7/024 4/606 |
| 9,254,185 | B2 * | 2/2016 | Vila | A46B 15/0006 |
| 9,414,669 | B2 * | 8/2016 | Fleischer | F21V 21/0885 |
| 9,428,914 | B2 | 8/2016 | Partis, Jr. | |
| 2004/0060107 | A1 * | 4/2004 | Eisenberg | A61H 9/00 4/605 |
| 2005/0039252 | A1 * | 2/2005 | Fainberg | A61H 35/00 4/605 |
| 2012/0078198 | A1 | 3/2012 | Leong | |
| 2014/0143962 | A1 * | 5/2014 | Mok | A61C 17/34 15/22.1 |
| 2016/0151133 | A1 * | 6/2016 | Luettgen | F04B 17/03 433/80 |
| 2016/0287034 | A1 * | 10/2016 | Woodard | B05B 1/18 |
| 2016/0287035 | A1 * | 10/2016 | Woodard | A46B 13/06 |
| 2019/0060919 | A1 | 2/2019 | Daru | |
| 2020/0181894 | A1 | 6/2020 | Chung | |
| 2020/0331007 | A1 | 10/2020 | Dierickx | |

FOREIGN PATENT DOCUMENTS

| | | | | | |
|---|---|---|---|---|---|
| CN | 105708678 | A | * | 6/2016 | A47K 3/28 |
| CN | 107661053 | A | * | 2/2018 | A47K 7/04 |
| CN | 107928510 | A | * | 4/2018 | A61H 15/0078 |
| CN | 108185870 | U | | 6/2018 | |
| CN | 108261128 | A | * | 7/2018 | A47K 7/04 |
| CN | 109365343 | A | * | 2/2019 | B08B 1/12 |
| CN | 110974070 | A | * | 4/2020 | A47K 7/04 |
| CN | 210330424 | U | | 4/2020 | |
| CN | 112376952 | A | * | 2/2021 | A47K 3/122 |
| CN | 115120126 | A | * | 9/2022 | A47K 7/04 |
| CN | 218654993 | U | * | 3/2023 | A47K 7/046 |
| CN | 116849535 | A | * | 10/2023 | A47K 3/28 |
| CN | 118592822 | A | * | 9/2024 | A61H 15/0078 |
| CN | 119366809 | A | * | 1/2025 | A61H 23/02 |
| DE | 102012011811 | A1 | * | 12/2013 | A47K 7/046 |
| GB | 2531820 | A | * | 5/2016 | A47K 7/03 |
| JP | 3210508 | U | | 5/2017 | |
| KR | 20210122550 | A | | 10/2021 | |
| WO | WO-9605796 | A1 | * | 2/1996 | E03C 1/063 |
| WO | WO-2005041712 | A1 | * | 5/2005 | A46B 13/008 |
| WO | WO-2012068185 | A1 | * | 5/2012 | A46B 13/02 |

* cited by examiner

SHOWER DEVICE

CROSS-REFERENCE TO RELATED PATENT APPLICATIONS

This application claims the benefit of and priority to Chinese Application No. 202222251129.2, filed Aug. 25, 2022, which is hereby incorporated by reference in its entirety.

TECHNICAL FIELD

The application relates to the field of bathroom products, and particularly to shower devices, such as hand shower and showerheads.

BACKGROUND

Hand showers and showerheads are used in showering applications for spraying or otherwise supplying water onto a user. Existing hand showers are designed to facilitate cleaning operations and to allow the user to direct water to different areas of their body. With improvements in people's standard of living, the functional requirements for the bathroom products, such as shower devices, are increasing. Some users also desire functionality, such as a massage function, that improves user comfort in addition to providing a cleaning function.

SUMMARY

Embodiments herein relate to an improved shower device that provides a massage function in addition to a cleaning function. At least one embodiment of the present disclosure relates to a shower device. The shower device includes a spray head and a massage assembly that is removably coupled to the spray head. In at least one embodiment, the massage assembly includes a massage brush head and a driving mechanism for driving or powering movement of the massage brush head relative to the spray head.

In some embodiments, the spray head defines a mounting opening therein, and the driving mechanism is pluggably mounted into the mounting opening. In some embodiments, the massage brush head is removably coupled with an output shaft of the driving mechanism. In some embodiments, at least part of the massage brush head protrudes outwardly from the spray head.

In at least one embodiment, the spray head includes a first magnet mounted to the spray head around the mounting opening, and the driving mechanism has a second magnet configured to magnetically couple to the first magnet.

In some embodiments, the first magnet is one of a plurality of magnets in the spray head that are arranged at intervals along a circumferential direction of the mounting opening. In such embodiments, the second magnet is one of a plurality of second magnets that are arranged at intervals in the driving mechanism along the circumferential direction.

In at least one embodiment, the spray head is a spray head assembly that includes a spray head main body, a sleeve, and a buckle cover. In some embodiments, the mounting opening is defined or otherwise provided by the spray head main body. In some embodiments, the sleeve is mounted within the mounting opening. In some embodiments, the driving mechanism passes through the sleeve. In some embodiments, the buckle cover is removably coupled to the shower head main body on a back side of the mounting opening. In some embodiments, the buckle cover includes a limiting plate for retaining or otherwise limiting a position of the first magnet within the spray head. The limiting plate is inserted into the mounting opening so that the first magnet is disposed between the limiting plate and a wall of the sleeve.

In some embodiments, the wall of the sleeve defines a positioning step for mounting the first magnet onto the sleeve, and the first magnet is disposed on the positioning step. In some embodiments, the shower device further comprises a spacer that is disposed or otherwise provided between the limiting plate and the first magnet.

In at least one embodiment, the output shaft has an anti-rotation connection end. In some embodiments, the massage brush head includes a brush head body and a connection sleeve coupled to the brush heat body. In some embodiments, the connection sleeve defines or otherwise includes an anti-rotation connection groove in the connection sleeve. In some embodiments, the output shaft includes an output shaft snap-fit part on one side of the anti-rotation connection end and a groove wall snap-fit part that is disposed or otherwise provided on a wall of the anti-rotation connection groove. Ins some embodiments, the anti-rotation connection end is disposed within the anti-rotation connection groove, and the groove wall snap-fit part is removably coupled with the output shaft snap-fit part.

In at least one embodiment, the output shaft snap-fit part is one of (i) an output shaft convex and (ii) an output shaft slot, and the groove wall snap-fit part is one of (i) a groove wall slot and (ii) a groove wall convex.

In at least one embodiment, the connection sleeve includes a plurality of connection pieces arranged at intervals along the circumferential direction. In some embodiments, the anti-rotation connection groove is formed between the plurality of connection pieces. In some embodiments, each of the connection pieces including the groove wall snap-fit part on an inner surface thereof.

In at least one embodiment, the driving mechanism includes a mechanism housing, a trigger button, a motor, a battery and a circuit board. Each of the trigger button, the motor, the battery, and the circuit board is at least partially disposed within the mechanism housing. In some embodiments, the battery and the circuit board are electrically coupled to the motor. In some embodiments, the motor includes a motor shaft that is coupled to the output shaft to transmit power from the motor to the output shaft. In some embodiments, the trigger button and the massage brush head are disposed at opposite ends of the mechanism housing. In some embodiments, the trigger button is slidingly coupled to, and is slidable with respect to, the mechanism housing and is capable of cooperating with and separating from a trigger end of the circuit board. In some embodiments, the second magnet is mounted in the mechanism housing. In some embodiments, the mechanism housing passes through the mounting opening.

Another embodiment of the present disclosure relates to a massage assembly for a shower device. The massage assembly includes a massage brush head and a driving mechanism. The driving mechanism is configured to removably couple the massage brush head to a spray head of the shower device. The driving mechanism is configured to move the massage brush head with respect to the spray head.

Yet another embodiment of the present disclosure relates to a method of installing or using a massage assembly for a spray head. The method includes inserting a driving mechanism of a massage assembly into a mounting opening of a spray head. The method also includes removably coupling the driving mechanism to the spray head so that a massage brush head of the massage assembly protrudes outwardly from the spray head.

Among other benefits, the shower device(s) described herein include a massage assembly that can improve user experience and comfort. The massage assembly is disposed or otherwise configured on the spray head, and the driving mechanism of the massage assembly is removably coupled with the spray head for ease of assembly and use. When the user desires a massage, the user activates the driving mechanism to power or drive the massage brush head to rotate and/or vibrate to provide the user with a massage.

The shower device designs of the present disclosure provide functionality by which a user can mount the massage assembly to the spray head if a massage operation is desired. After use, the user can remove the massage assembly from the spray head which can reduce the weight of the spray head and make it easier to use for cleaning operations.

Additionally, the design of the spray head and massage assembly is such that the user can assemble the massage brush heads with different functions to the output shaft of the driving mechanism to achieve different massage functions. For example, the user can install massage assemblies that provide one, or a combination or, a cleansing massage function, a dandruff removal massage function, a scrub back massage function, a rolling massage function, or other functions.

The various embodiments described herein allow for the massage assembly to be used separately from the spray head, and allow for the use of different massage brush heads according to the user's needs. The integration of multiple functions on a shower device makes the structure of the spray head simple and practical, and expands the performance of the shower device, thereby enhancing the shower experience that the shower device provides to users.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Figure 1:
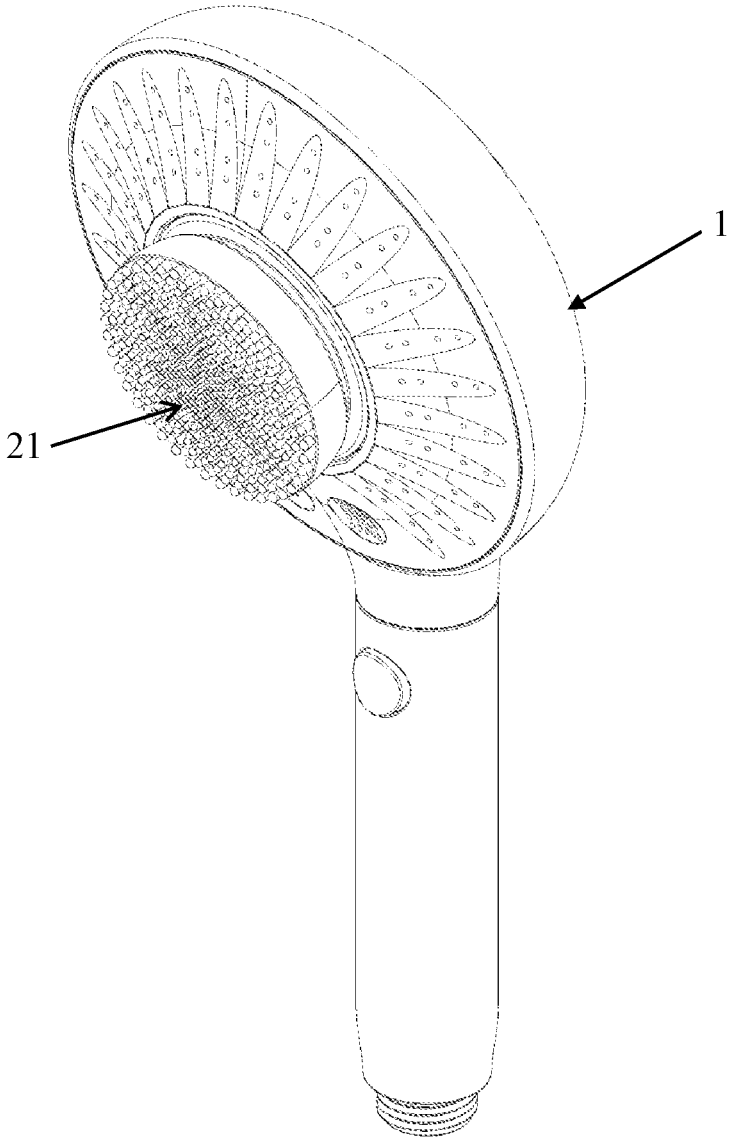
FIG. 1 is a perspective view of a shower device, according to an embodiment.

Various embodiments of the application will be described with reference to the drawings hereinafter. For convenience, the same components in the figures are denoted by same reference numerals. It should be understood that the terms "front", "back", "left", "right", "up" and "down" used in the following description refer to the directions in the figures, and the terms "inner" and "outer" refer generally to directions towards or away from geometric centers of specific parts, respectively.

Referring to FIGS. 1-3 and FIG. 9, a shower device according to an embodiment of the present application is shown. The shower device includes a spray head 1 and a massage assembly 2 that is removably coupled to the spray head 1.

The massage assembly 2 comprises a massage brush head 21 and a driving mechanism 22 for driving the massage brush head 21 to move (e.g., relative to the spray head 1).

The spray head 1 defines a mounting opening 110 (e.g., a mounting hole, etc.) therein. The driving mechanism 22 is insertable in the mounting opening 110. In some embodiments, the driving mechanism 22 is pluggably mounted into the mounting opening (e.g., is configured to plug into the mounting opening 110, etc.).

In at least one embodiment, the massage brush head 21 is removably coupled to an output shaft 220 of the driving mechanism 22. At least a portion of the massage brush head 21 protrudes from the spray head 1 (e.g., from a spray face of the spray head 1 as shown in FIG. 1 that includes nozzle openings of the spray head).

Figure 2:
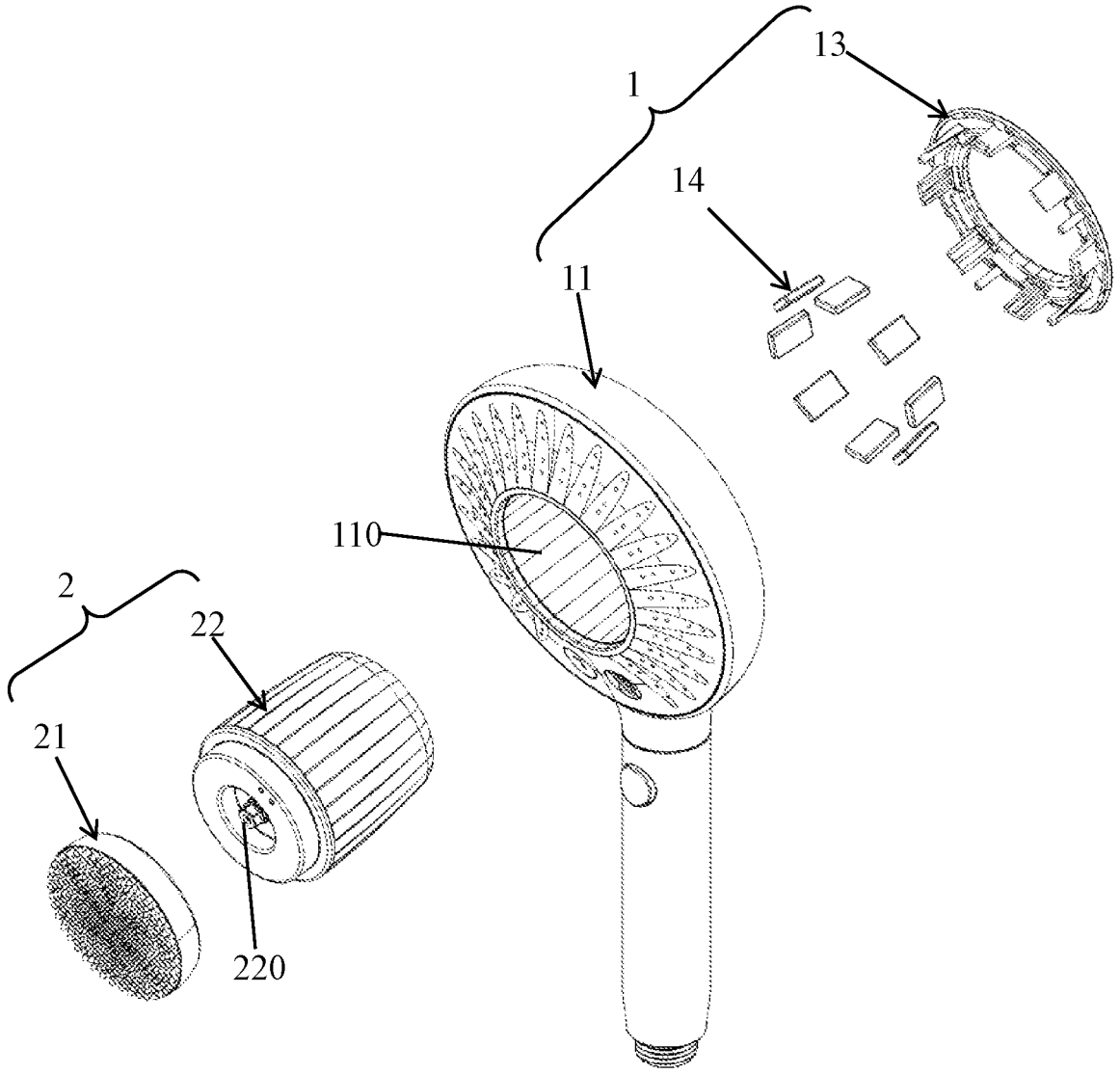
FIG. 2 is an exploded view of the shower device of FIG. 1.

The shower device provides an integrated massage function via the removable massage assembly 2. As shown in FIG. 2, the mounting opening 110 is a central opening disposed in the middle of the spray head 1.

Figure 3:
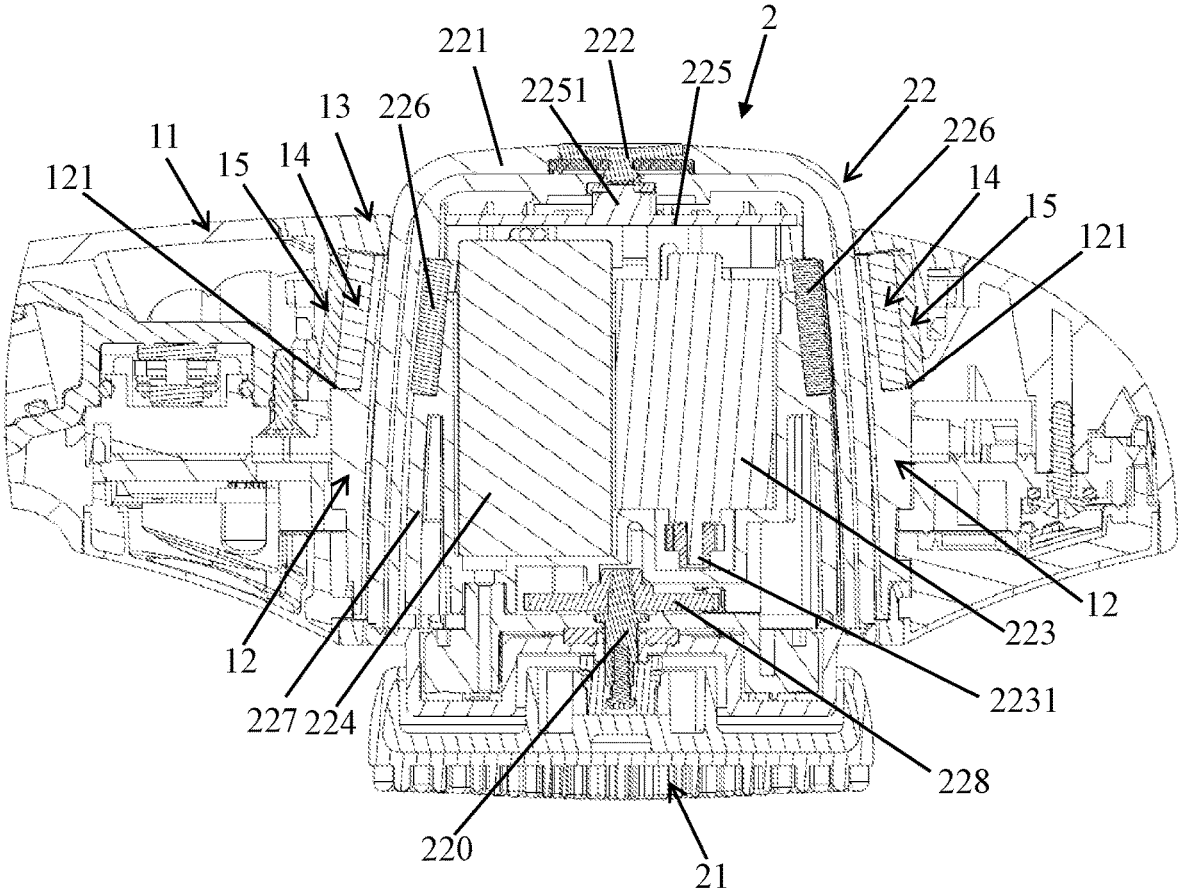
FIG. 3 is a cross-sectional view of a massage assembly and a spray head of the shower device of FIG. 1, with the massage assembly and the spray head shown assembled together.

Referring to FIG. 2 and FIG. 3, in some embodiments, the massage assembly 2 includes a massage brush head 21 and a driving mechanism 22. The driving mechanism 22 is configured to drive the massage brush head 21 to rotate with respect to the spray head 1 and/or vibrate. The driving mechanism 22 may be a rotary driving mechanism and/or a vibration driving mechanism, etc. The rotary driving mechanism and/or vibration driving mechanism may be a rotary motor, a vibration motor, or a rotary vibration motor with both an integrated rotary function and vibration function. The driving mechanism 22 may employ a physical push button switch or a remote control signal switch to control activation thereof.

The driving mechanism 22 is removably coupled to the spray head 1 at the mounting opening 110. The driving mechanism 22 can be assembled into the mounting opening 110 in a pluggable way such as by snap-fitting, a threaded connection, a magnetic connection, etc., so that the driving mechanism 22 can be inserted into the mounting opening 110 or pulled out from the mounting opening 110 to be used independently from the spray head 1 as a standalone massager.

The output shaft 220 is disposed on a front side of the driving mechanism 22. As used herein, the "front side" refers to a side of the driving mechanism 22 facing a spray face of the spray head 1 through which water is delivered to a user, and the "back side" refers to the side facing away from the spray face.

The massage brush head 21 is disposed the front side of the spray head 1. A portion of the massage brush head 21 protrudes away from the spray head 1, forward of the spray head 1. The massage brush head 21 is removably coupled to the output shaft 220 of the driving mechanism 22. In some embodiments, the massage brush head 21 and the output shaft 220 are assembled together by snap-fitting, a threaded connection, etc., which allows for the replacement of the massage brush head 21 with different massage brush heads that provide different functions.

Figure 9:
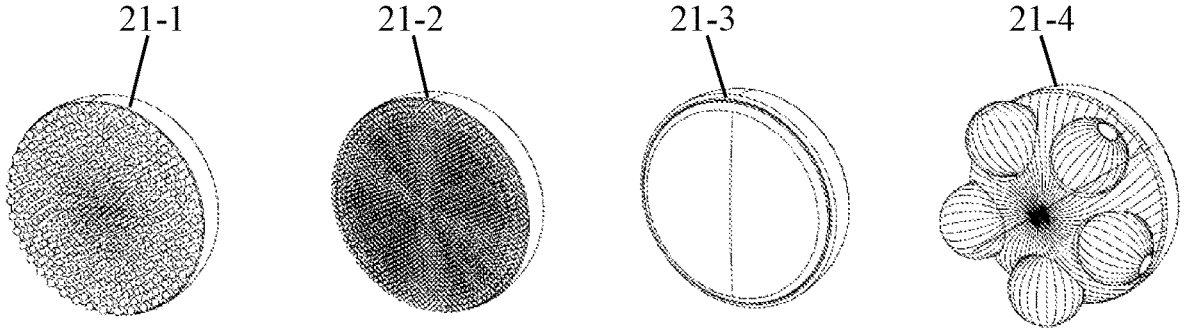
FIG. 9 is a schematic view of a massage brush head with four functions, according to an embodiment.

Referring to FIG. 9, massage brush head structures are shown, according to various embodiments. The massage brush head 21-1 is a facial cleansing massage brush head with cleansing function, the massage brush head 21-2 is a scrub back massage brush head with scrub back function, the massage brush head 21-3 is a dandruff removal massage brush head with dandruff removal function, the massage brush head 21-4 has a rolling massage brush head with rolling massage function. The various heads can be selected by the user based on the desired functionality and can all be used with the same shower device (e.g., with the spray head 1).

When the user needs a massage, he/she can activate the driving mechanism 22 to drive the massage brush head 21 to rotate and/or vibrate to massage the user.

The user can place the massage assembly 2 onto the spray head 1 when a massage operation is desired. After use, the user can remove the massage assembly 2 from the spray head 1 to simplify manipulation/use of the spray head 1 during cleaning operations.

As described above, and based on user preferences, the user can assemble different massage brush head 21 with different functions to the output shaft 220 of the driving mechanism 22 to achieve different massage functions. For example, the user to couple or otherwise place the massage brush head 21-1 onto the output shaft 220 to provide a cleansing massage function, or the massage brush head 21-3 to provide a dandruff removal massage function, or the massage brush head 21-2 to provide a scrub back massage function, or the massage brush head 21-4 to provide a rolling massage function. It should be appreciated that other massage brush head designs could be used to provide other massage functions to the user.

Referring again to FIGS. 1-3, the massage assembly 2 can be used separately from the spray head 1. Different massage brush heads can be used according to the user's preferences and needs. The integration of multiple massage functions into the shower device reduces the complexity of the shower device, and expands performance, thereby enhancing the shower experience that the shower device provides to users.

Referring to FIGS. 2-5, in some embodiments, the massage assembly 2 is magnetically coupled to the spray head 1. The spray head 1 includes a first magnet 14 mounted around the mounting opening 110. The driving mechanism 22 includes a second magnet 226 that is magnetically attracted to the first magnet 14.

In such an embodiment, the first magnet 14 may be mounted within the spray head 1. In some embodiments, the first magnet 14 is disposed around the mounting opening 110, such as adjacent to a perimeter wall of the mounting opening 110. The second magnet 226 is mounted in the driving mechanism 22. The second magnet 226 has a magnet pole opposite to the first magnet 14, and the second magnet 226 and the first magnet 14 attract to each other magnetically to secure the driving mechanism 22 into the mounting opening 110.

The second magnet 226 and the first magnet 14 may be one, or a combination of, a ring magnet, a block magnet, a bar magnet, or another type of magnet.

In some embodiments, the first magnet 14 is sealed in the spray head 1, which can prevent exposure of the first magnet 14 to water. In some embodiments, the second magnet 226 is mounted in a mechanism housing of the driving mechanism 22 that is adjacent to the perimeter wall of the mounting opening 110.

Still referring to FIGS. 2-5, in some embodiments, the first magnet 14 is one of a plurality of the first magnets that are arranged in the spray head 1 at intervals along a circumference direction of the mounting opening 110. Note that the spray head 1 may include more than one mounting opening 110 in some embodiments and may include a massage assembly 2 at one or more of the mounting openings 110. In such an implementation, the second magnet 226 is one of a plurality of second magnets that are arranged in the driving mechanism 22 at intervals along the circumferential direction. In some embodiments, the arrangement (e.g., the spacing, location, etc.) of the plurality of second magnets corresponds with the arrangement of the plurality of first magnets.

In such arrangements, the first magnets 14 are arranged or spaced at intervals along the circumferential direction of the mounting opening 110. The second magnets 226 may also also arranged at intervals along the circumferential direction of the mounting opening 110. In some embodiments, the number of the second magnets 226 is equal to the number of the first magnets 14, and each second magnet 226 is magnetically coupled to a respective one of the first magnets 14. Such an arrangement can improve the stability of the driving mechanism 22 being mounted into the mounting opening 110.

Figure 4:
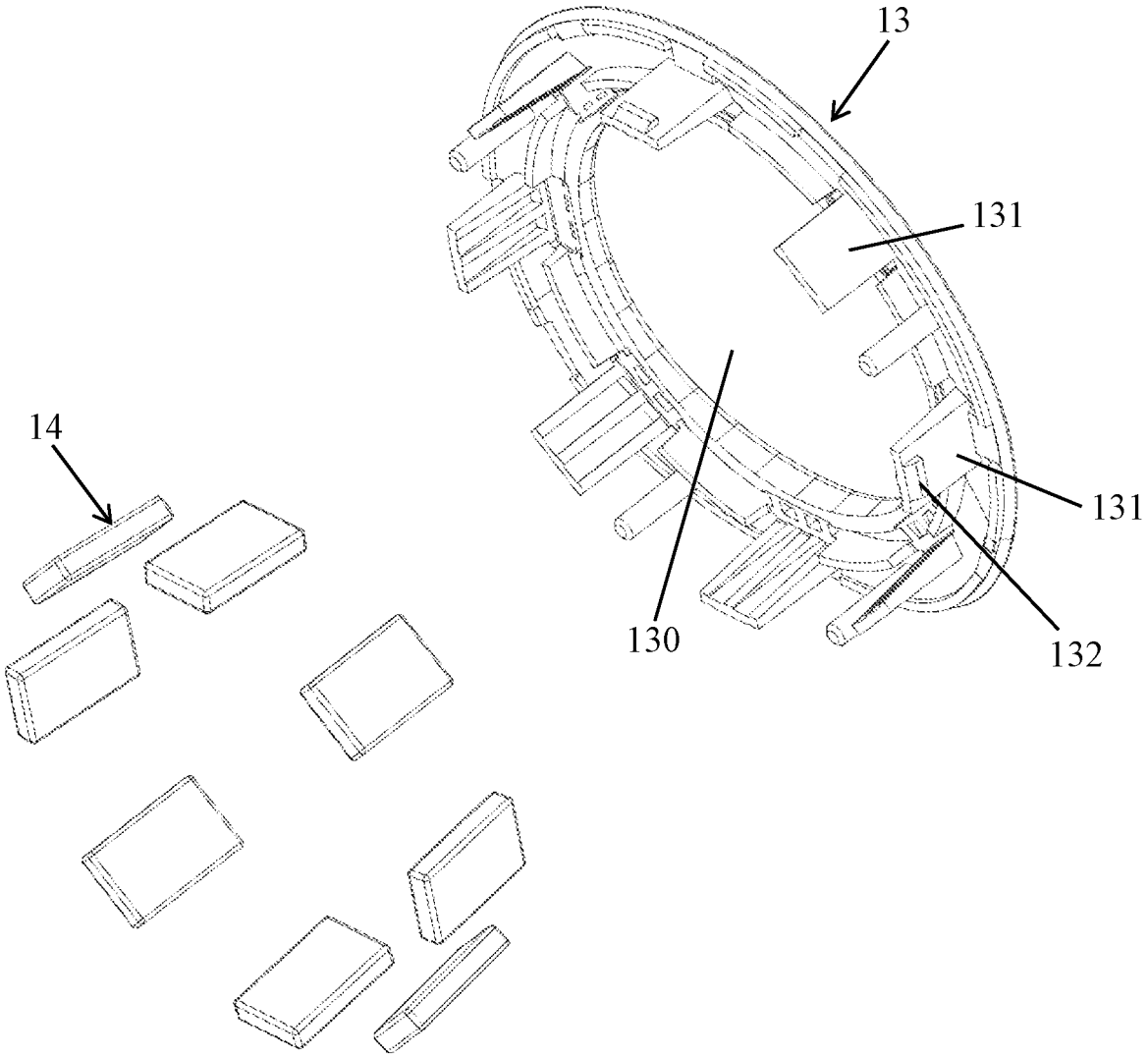
FIG. 4 is an exploded view of a buckle cover and a first magnet of the shower device of FIG. 1.

Referring to FIGS. 2-4, in some embodiments, the spray head 1 comprises a spray head main body 11 (e.g., a shower head, etc.), a sleeve 12, and a buckle cover 13.

Referring to FIG. 3, in some embodiments, the mounting opening 110 is provided in the spray head main body 11, the sleeve 12 is mounted into the mounting opening 110, and the driving mechanism 22 passes through the sleeve 12.

Referring to FIG. 2, the buckle cover 13 may be removably mounted on a back side of the mounting opening 110. Referring to FIG. 3, the buckle cover 13 may include a limiting plate 131 for limiting movement the first magnet 14 after installation.

In some embodiments, the limiting plate 131 is inserted into the mounting opening 110, the first magnet 14 is located between the limiting plate 131 and a wall of the sleeve 12. In such an embodiment, the spray head 1 includes a spray head main body 11, a sleeve 12, and a buckle cover 13. The mounting opening 110 is a central opening formed in the middle of the spray head main body 11.

Referring to FIG. 3, the sleeve 12 is inserted from the front side of the spray head main body 11 and into the mounting opening 110. The first magnet 14 is located on the outer (radial) side of the wall of the sleeve 12.

Referring to FIG. 4, in some embodiments, the central portion of the buckle cover 13 defines a through hole 130 (e.g., a through hold opening, etc.) for the rear end of the driving mechanism 22 to pass through. A limiting plate 131 extending (axially) towards the mounting opening 110 is provided at the edge (e.g., an inner radial edge) of the buckle cover 13. In some embodiments, the number of the limiting plates 131 is equal to the number of the first magnets 14. The limiting plate 131 secures the first magnets 14 into the spray head and limits movement of the first magnet 14 relative to the spray head.

Referring again to FIG. 3, a main part of the buckle cover 13 is coupled to the spray head at the mounting opening 110 on the back side of the spray head 1 (and the back side of the mounting opening 110). The limiting plate 131 extends into the mounting opening 110 from the back side and surrounds (e.g., circumscribes) the outer side of the sleeve 12. The first magnet 14 is assembled and disposed (both radially and axially) between the limiting plate 131 and the wall of the sleeve 12.

The driving mechanism 22 passes through the sleeve 12 from the front to the back of the spray head 1. In some embodiments, the rear end of the driving mechanism 22 protrudes from the through hole 130 to allow a user to operate a trigger button 222 disposed at the rear end of the driving mechanism 22.

Referring still to FIGS. 3, in some embodiments, the wall of the sleeve 12 defines a positioning step 121 for mounting the first magnet 14. The first magnet 14 is located on and may engage the positioning step 121 during assembly, which improves the assembly stability of the first magnet 14.

In some embodiments, a spacer 15 is provided between the limiting plate 131 and the first magnet 14. In some embodiments, the spacer 15 is a rubber spacer that is configured to protect the first magnet 14 and to prevent damage due to vibration from impact.

Figure 6:
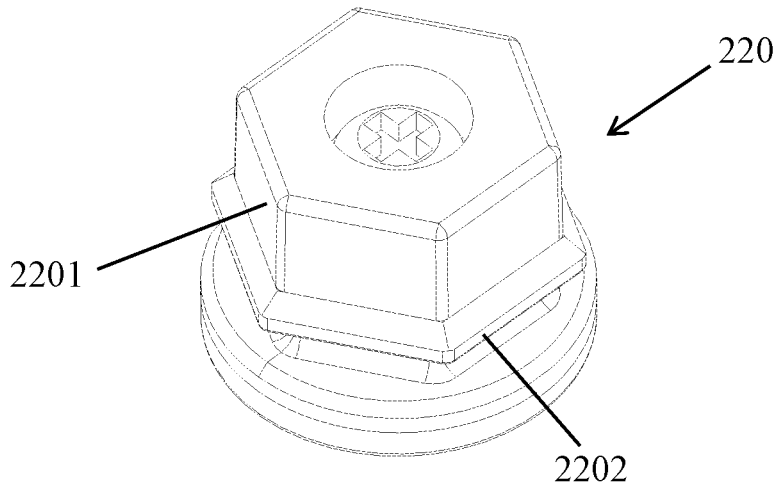
FIG. 6 is a perspective view of an output shaft for a shower device, according to an embodiment in which the output shaft includes an anti-rotation connection end and an output shaft clamping part.
Figure 7:
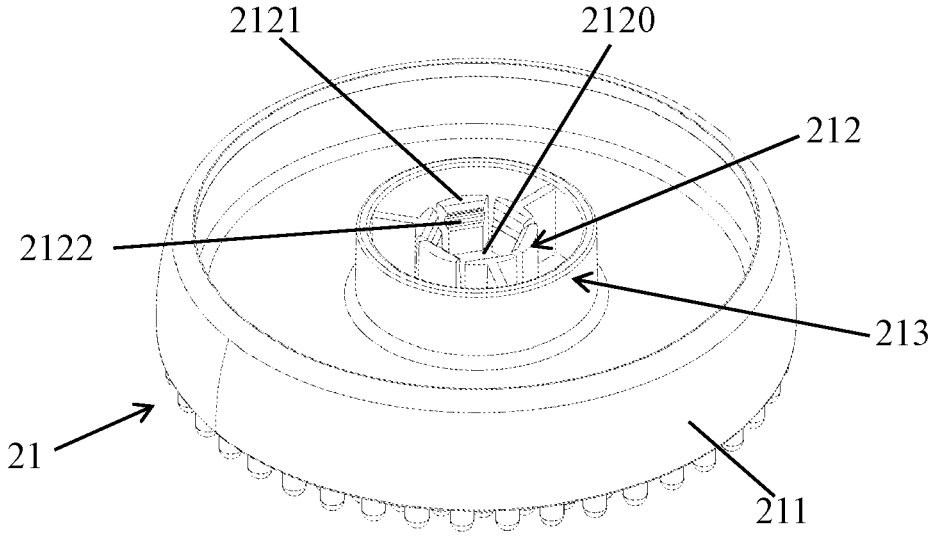
FIG. 7 is a perspective view of a massage brush head for a shower device, according to an embodiment.
Figure 8:
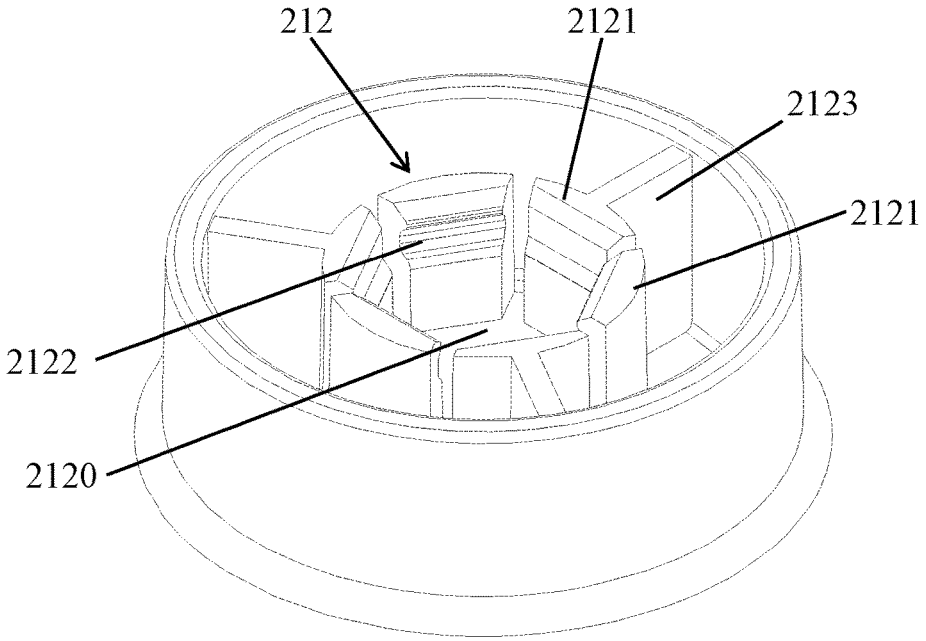
FIG. 8 is an enlarged schematic view of a connection sleeve for a shower device, according to an embodiment.

Referring to FIGS. 6-8, in some embodiments, the output shaft 220 has an anti-rotation connection end 2201. The massage brush head 21 includes a brush head body 211 and a connection sleeve 212 connected to the brush head body 211. The connection sleeve 212 includes an anti-rotation connection groove 2120.

Referring still to FIGS. 6-8, in some embodiments, the output shaft 220 has an output shaft snap-fit member 2202 (e.g., an output shaft snap-fit part, etc.) on one side of the anti-rotation connection end 2201. A groove wall snap-fit member 2122 (e.g., a groove wall snap-fit part, etc.) is provided on the wall of the anti-rotation connection groove 2120. The anti-rotation connection end 2201 is assembled in the anti-rotation connection groove 2120. The groove wall snap-fit member 2122 is removably coupled to the output shaft snap-fit member 2202.

In such embodiments, the end of the output shaft 220 has an anti-rotation connection end 2201, and the anti-rotation connection end 2201 is a non-circular connection end, which may be polygonal in structure, such as hexagonal in structure, to facilitate torque transmission.

The output shaft 220 also has an output shaft snap-fit member 2202 disposed thereon, which is on the rear side of the anti-rotation connection end 2201. The output shaft snap-fit member 2202 may be or include jaws, a slot, a convex rib and/or other structures.

The massage brush head 21 includes a brush head body 211 and a connection sleeve 212. The connection sleeve 212 is coupled to the back side of the brush head body 211. The connection sleeve 212 has an anti-rotation connection groove 2120 at the end facing the output shaft 220. The anti-rotation connection groove 2120 is a non-circular connection groove, and may be of polygonal structure, such as a hexagonal structure, to cooperate with the anti-rotation connection end 2201 for torque transmission.

The anti-rotation connection groove 2120 has a groove wall snap-fit member 2122 on an inner surface of the groove wall. The groove wall snap-fit member 2122 is configured to cooperate with the output shaft snap-fit member 2202 to prevent the massage brush head 21 from detaching from the output shaft 220. In some embodiments, the groove wall snap-fit member 2122 is provided with a corresponding buckle, a convex rib, a slot, and/or other structures corresponding to the output shaft snap-fit member 2202.

When the massage brush head 21 needs to be disassembled and replaced, a user pulls the massage brush head 21 along the axial direction of the output shaft 220, so that the groove wall snap-fit member 2122 is detached from the output shaft snap-fit member 2202, and the massage brush head 21 can be removed from the output shaft 220.

When the massage brush head 21 needs to be installed, a user aligns the anti-rotation connection groove 2120 with the anti-rotation connection end 2201, and pushes the massage brush head 21 along the axial direction of the output shaft 220, so that the groove wall snap-fit member 2122 cooperates with the output shaft snap-fit member 2202, to snap-fit the massage brush head 21 onto the output shaft 220.

In some embodiments, the output shaft snap-fit member 2202 is an output shaft convex or an output shaft slot and the groove wall snap-fit member 2122 is a groove wall slot or a groove wall convex, respectively.

When the output shaft snap-fit member 2202 is an output shaft convex provided on the output shaft 220, the groove wall snap-fit member 2122 is a groove wall slot provided on the inner surface of the groove wall. In such embodiments, the output shaft convex may be an annular convex rib, and the groove wall slot may be an annular recess that corresponds with the output shaft convex.

When the output shaft snap-fit member 2202 is an output shaft slot provided on the output shaft 220, the groove wall snap-fit member 2122 is a groove wall convex provided on the inner surface of the groove wall. In such embodiments, the output shaft slot may include an annular recess, and the groove wall convex may be an annular convex rib that corresponds with the annular recess.

Referring to FIGS. 7-8, in some embodiments, the connection sleeve 212 includes a plurality of connection pieces 2121 arranged at intervals along the circumferential direction. The anti-rotation connection groove 2120 is formed between the connection pieces 2121. The groove wall snap-fit member 2122 is provided on an inner surface of each of the connection pieces.

In such an embodiment, the connection sleeve 212 includes a plurality of connection pieces 2121, and the plurality of connection pieces 2121 are arranged at intervals along the circumferential direction. The connection pieces 2121 are a resilient piece with resilient deformation capability (e.g., that deform elastically during assembly and disassembly without any permanent deformation).

The anti-rotation connection groove 2120 is surrounded by the plurality of connection pieces 2121. The groove wall snap-fit member 2122 is provided on the inner (radial) surface of each the connection pieces 2121.

When the massage brush head 21 is mounted to the output shaft 220, the connection pieces 2121 are elastically deformed under the action of thrust to facilitate the insertion of the anti-rotation connection end 2201 into the anti-rotation connection groove 2120. After insertion, the groove wall snap-fit member 2122 nestably engages the output shaft snap-fit member 2202.

When disassembling or removing the massage brush head 21 from the output shaft 220, the connection piece 2121 is also elastically deformed under the action of the pulling force to facilitate the disengagement of the groove wall snap-fit member 2122 from the output shaft snap-fit member 2202.

In some embodiments, a back side of the brush head body 211 is also coupled to a positioning sleeve 213. The connection sleeve 212 may be disposed within the positioning sleeve 213, such that the connection sleeve 212 circumscribes the positioning sleeve 213. The positioning sleeve 213 is configured to facilitated positioning of the massage brush head 21 within a positioning recess defined by the driving mechanism 22, and within which the output shaft 220 is located.

In some embodiments, the massage brush head 21 includes ribs extending radially between the positioning sleeve 213 and respective ones of the connection pieces 2121. In the embodiment of FIG. 7, the ribs engage every other one of the connection pieces 2121 (adjacent ones of the connection pieces 2121), so that in any adjacent two connection pieces 2121, one of the connection pieces 2121 is coupled to the positioning sleeve 213 by a rib for maintaining the structural stability of the corresponding connection piece 2121.

Figure 5:
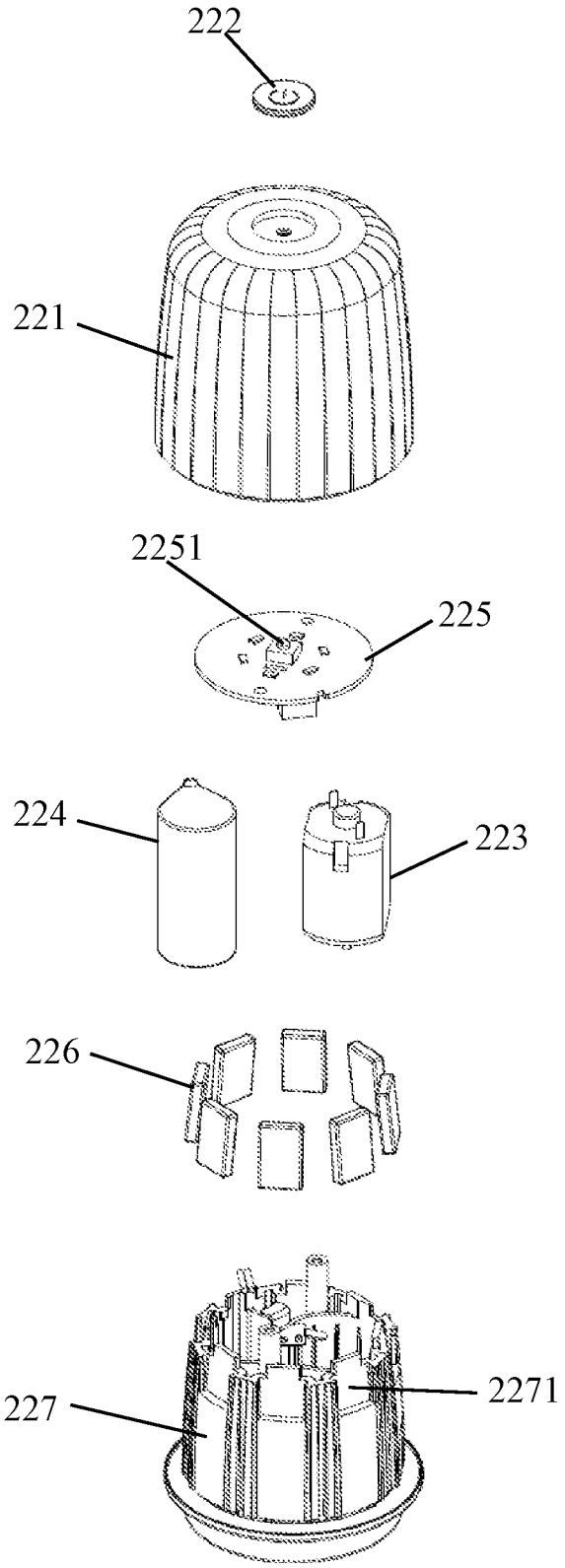
FIG. 5 is an exploded view of a massage assembly for a shower device, according to an embodiment.

Referring to FIG. 3 and FIG. 5, in some embodiments, the driving mechanism 22 includes a mechanism housing 221. The mechanism housing 221 houses a trigger button 222, a motor 223, a battery 224, and a circuit board 225.

The battery 224 and the circuit board 225 are electrically coupled to the motor 223. A motor shaft 2231 of the motor 223 is coupled to the output shaft 220 to transmit force from the motor to the output shaft 220.

In some embodiments, the trigger button 222 and the massage brush head 21 are located at opposite ends of the mechanism housing 221.

The trigger button 222 is slidingly coupled to the mechanism housing 221 so that the trigger button 222 can slide with respect to the mechanism housing 221. The trigger button 222 is configured to cooperate with and separate from a trigger end 2251 of the circuit board 225.

The second magnet 226 is mounted in the mechanism housing 221. The mechanism housing 221 passes through the mounting openings 110.

In such an embodiment, the driving mechanism 22 is a motor driven mechanism, which comprises a mechanism housing 221, a trigger button 222, a motor 223, a battery 224 and a circuit board 225. The motor 223, the battery 224, the circuit board 225 and the second magnet 226 are mounted in the mechanism housing 221.

In some embodiments, the trigger button 222 is mounted at the rear of the mechanism housing 221. In some embodiments, the trigger end 2251 of the circuit board 225 faces toward the trigger button 222.

The battery 224 supplies power to the motor 223. The battery 224 may be a storage battery or a rechargeable battery. When a rechargeable battery is used, the rechargeable battery is electrically coupled to the circuit board 225.

The circuit board 225 is configured to control the switching (e.g., activation, deactivation, etc.) of the motor 223. The motor 223 may be a rotary motor, a vibration motor, or a rotary vibration motor. The output shaft 220 is connected to the motor shaft 2231 of the motor 223 to transmit power from the motor 223 to the motor shaft 2231. The output shaft 220 and the motor shaft 2231 may be directly coupled to one another or may be coupled by a transmission mechanism 228. The transmission mechanism 228 may be a transmission wheel, transmission belt, transmission gear set, or another transmission component.

In operation, the user presses the trigger button 222 to trigger the trigger end 2251 of the circuit board 225 to turn on the motor 223. The user may press the trigger button 222 again to trigger the trigger end 2251 of the circuit board 225 again to turn off the motor 223.

In some embodiments, the driving mechanism 22 includes a connection base 227 that is mounted or otherwise disposed within the mechanism housing 221. The connection base 227 defines a support step 2271 extending along the circumferential direction of the connection base 227. The second magnet 226 is assembled on and/or engages the support step 2271 for improved assembly stability.

In some embodiments, the connection base 227 includes at least two assembly holes (e.g., assembly openings, recessed areas, etc.). The assembly holes may be spaced apart or otherwise disposed at intervals along the connection base 227. The motor 223 and the battery 224 are mounted in the two assembly holes of the connection base 227. In some embodiments, the circuit board 225 is mounted at the (axial) end of the connection base 227 facing the trigger button 222, the transmission mechanism 228 is in a cavity of the connection base 227 at an opposite end of the connection base 227 as the circuit board 225, and the output shaft 220 penetrates and extends through an end of the connection base 227.

In some embodiments, the mechanism housing 221, the connection base 227, the spray head main body 11, the sleeve 12, and the buckle cover 13 are all plastic parts.

Embodiments described herein may be combined as required to achieve the best technical effect.

The embodiments described herein are provided for illustrative purposes only and should not be considered limiting. Those skilled in the art would understand that various modifications may be made on the basis of the principles disclosed herein, all of which should be regarded as falling within the scope of the present application.

What is claimed is:

1. A shower device, comprising:

a spray head defining a mounting opening; and a massage assembly removably coupled to the spray head, the massage assembly including:

a massage brush head; and a driving mechanism for driving the massage brush head to move with respect to the spray head, the driving mechanism pluggably mounted into the mounting opening so that the massage assembly is usable independently from the spray head as a standalone massager, the massage brush head removably coupled to an output shaft of the driving mechanism, the massage brush head at least partially protruding from the spray head.

2. The shower device of claim 1, wherein the spray head includes a first magnet coupled to the spray head around the mounting opening, and the driving mechanism further includes a second magnet configured to magnetically couple to the first magnet.

3. The shower device of claim 2, wherein the first magnet is one of a plurality of first magnets in the spray head that are arranged at intervals along a circumferential direction of the mounting opening, and the second magnet is one of a plurality of second magnets that are arranged at intervals in the driving mechanism along the circumferential direction.

4. The shower device of claim 2, wherein the spray head comprises:

a shower head main body that defines the mounting opening;

a sleeve mounted within the mounting opening, the driving mechanism passing through the sleeve; and a buckle cover removably coupled to the shower head main body on a back side of the mounting opening, the buckle cover including a limiting plate for retaining the first magnet, the limiting plate inserted into the mounting opening so that the first magnet is located between the limiting plate and a wall of the sleeve.

5. The shower device of claim 4, wherein the wall of the sleeve defines a positioning step, the first magnet is disposed on the positioning step.

6. The shower device of claim 4, further comprising a spacer disposed between the limiting plate and the first magnet.

7. The shower device of claim 1, wherein the output shaft includes an anti-rotation connection end, the massage brush head including a brush head body and a connection sleeve coupled to the brush head body, the connection sleeve defining an anti-rotation connection groove, the output shaft including an output shaft snap-fit member on one side of the anti-rotation connection end and a groove wall snap-fit member on a wall of the anti-rotation connection groove, the anti-rotation connection end disposed within the anti-rotation connection groove, the groove wall snap-fit member removably coupled to the output shaft snap-fit member.

8. The shower device of claim 7, wherein the output shaft snap-fit member is one of (i) an output shaft convex or (ii) an output shaft slot, and the groove wall snap-fit member is one of (i) a groove wall slot or (ii) a groove wall convex.

9. The shower device of claim 7, wherein the connection sleeve comprises a plurality of connection pieces arranged at intervals along a circumferential direction of the mounting opening, the anti-rotation connection groove formed between the plurality of connection pieces, each of the plurality of connection pieces including the groove wall snap-fit member on an inner surface thereof.

10. The shower device of claim 1, wherein the driving mechanism further comprises a mechanism housing, a trigger button, a motor, a battery, and a circuit board, each of the trigger button, the motor, the battery, and the circuit board at least partially disposed within the mechanism housing, the battery and the circuit board are electrically coupled to the motor, the motor including a motor shaft that is coupled the output shaft to transmit power from the motor to the output shaft, the trigger button and the massage brush head disposed at opposite ends of the mechanism housing, the trigger button slidingly coupled to the mechanism housing and capable of cooperating with and separating from a trigger end of the circuit board, the driving mechanism further including a second magnet mounted in the mechanism housing, the mechanism housing passing through the mounting opening.

11. A massage assembly for a shower device, the massage assembly comprising:

a massage brush head; and a driving mechanism configured to removably couple the massage brush head to a spray head of the shower device, the driving mechanism configured to move the massage brush head with respect to the spray head, the massage brush head and the driving mechanism configured to be usable independently from the spray head as a standalone massager.

12. The massage assembly of claim 11, wherein the driving mechanism includes a magnet configured to magnetically couple the driving mechanism to the spray head of the shower device.

13. The massage assembly of claim 12, wherein the magnet is one of a plurality of magnets that are arranged at intervals in the driving mechanism along a circumferential direction.

14. The massage assembly of claim 11, wherein the driving mechanism further comprises a mechanism housing, a trigger button, a motor, a battery, and a circuit board, each of the trigger button, the motor, the battery, and the circuit board at least partially disposed within the mechanism housing.

15. The massage assembly of claim 14, wherein the trigger button and the massage brush head are disposed at opposite ends of the mechanism housing.

16. The massage assembly of claim 11, wherein the driving mechanism comprises:

a mechanism housing;

a connection base that is disposed within the mechanism housing, the connection base defining a support step extending along a circumferential direction of the connection base; and a magnet disposed on the support step.

17. The massage assembly of claim 16, wherein the connection base includes at least two assembly openings that are spaced apart from one another, the driving mechanism further comprising a motor and a battery that are disposed in respective ones of the at least two assembly openings.

18. A method, comprising:

inserting a driving mechanism of a massage assembly into a mounting opening of a spray head;

removably coupling the driving mechanism to the spray head so that a massage brush head of the massage assembly protrudes outwardly from the spray head; and removing the massage assembly including both the driving mechanism and the massage brush head together from the spray head for use separately from the spray head as a standalone massager.

19. The method of claim 18, wherein removably coupling the driving mechanism to the spray head includes magnetically coupling a first magnet in the spray head around the mounting opening to a second magnet in the driving mechanism.

20. The method of claim 18, further comprising removably coupling a massage head brush to the driving mechanism.

* * * * *